US006650862B2

(12) United States Patent
Nakano et al.

(10) Patent No.: US 6,650,862 B2
(45) Date of Patent: Nov. 18, 2003

(54) IMAGE FORMING APPARATUS HAVING SHEET SEPARATOR AND SHEET SEPARATOR FOR USE IN IMAGE FORMING APPARATUS

(75) Inventors: Kuniaki Nakano, Oji-Cho (JP); Eiji Nakajima, Mino (JP); Masami Fuchi, Daito (JP)

(73) Assignee: Kyocera Mita Corporation, Osaka (JP)

( * ) Notice: Subject to any disclaimer, the term of this patent is extended or adjusted under 35 U.S.C. 154(b) by 88 days.

(21) Appl. No.: 10/096,155

(22) Filed: Mar. 12, 2002

(65) Prior Publication Data

US 2002/0141792 A1 Oct. 3, 2002

(30) Foreign Application Priority Data

Mar. 28, 2001 (JP) ..... 2001-093880
Mar. 30, 2001 (JP) ..... 2001-099304

(51) Int. Cl.[7] ..... G03G 15/20

(52) U.S. Cl. ..... 399/323; 271/307; 271/311; 271/900

(58) Field of Search ..... 399/323, 322, 399/398, 399, 320; 271/307, 308, 311, 900

(56) References Cited

U.S. PATENT DOCUMENTS 4,475,804 A * 10/1984 Kanno et al. ..... 271/311
5,623,720 A * 4/1997 Howe et al. ..... 399/323
5,802,434 A * 9/1998 Takehara et al. ..... 271/308
6,205,316 B1 * 3/2001 Iida ..... 271/307
6,259,881 B1 * 7/2001 Nakamura ..... 399/323

* cited by examiner

*Primary Examiner*—Susan S. Y. Lee
(74) *Attorney, Agent, or Firm*—Jordan and Hamburg LLP

(57) ABSTRACT

Disclosed is an image forming apparatus that enables to transversely move a sheet separator without a dedicated drive source and with a simplified construction to thereby reduce production cost of the apparatus. The image forming apparatus includes a thrust driving mechanism for reciprocating the sheet separator in an axial direction of a heater roller. The mechanism includes a worm gear which is rotated by a driving force of a drive source for rotating the heater roller, a helical gear which is meshed with the worm gear, and an eccentric cam which is mounted coaxially with an axis of rotation of the helical gear. A guide member for supporting the sheet separator is reciprocated in the axial direction of the heater roller in accordance with rotation of the eccentric cam.

19 Claims, 11 Drawing Sheets

IMAGE FORMING APPARATUS HAVING SHEET SEPARATOR AND SHEET SEPARATOR FOR USE IN IMAGE FORMING APPARATUS

BACKGROUND OF THE INVENTION

1. Field of the Invention

This invention relates to an image forming apparatus, and more particularly pertains to a mechanism for moving a sheet separator member in an axial direction of a roller to separate a sheet from the roller in an image forming apparatus.

2. Description of the Related Art

Heretofore, there has been known an image forming apparatus such as an electrophotographic copying machine and a printer provided with a fixing device in which a sheet is nipped by a nip portion of a fixing roller unit comprising a heater roller and a presser roller to fix an image on the sheet by heat/press operation of the fixing roller unit. A pawl-like sheet separator member is provided at such a position on the heater roller and the presser roller as to come into contact therewith at a certain contact pressure in order to keep a sheet from undesirably winding around the heater roller and the presser roller.

The fixing roller unit provided with such a sheet separator member has suffered from the following drawbacks. A long-time contact of the separator member with the heater roller (or the presser roller) at the same location may damage the surface of the roller due to abrasion or frictional resistance with the sheet separator member. Furthermore, as toner particles intrude into a space between the roller surface and the sheet separator member and resultantly deposit on the sheet separator member, abrasion is progressed, and damage on the roller surface becomes serious. In addition, redundant toner particles may adhere on a sheet under image fixation with the result that the sheet may be smeared or jammed.

In order to prevent such a drawback, there has been proposed an image forming apparatus provided with a thrust driving mechanism for moving a sheet separator member in an axial direction of the roller while keeping the sheet separator member in contact with the surface of the roller in an attempt to shorten a period for contacting the sheet separator member at the same location on the roller surface.

The aforementioned image forming apparatus, however, requires a drive source such as a solenoid, in addition to a drive source for driving a fixing roller unit, so as to move the sheet separator member with use of the thrust driving mechanism, which raises production cost of the apparatus. Also, there has been proposed a driving mechanism of a so-called "one-way-bearing type" to transversely move the sheet separator member by utilizing a driving force of a drive source for a fixing roller unit. However, the arrangement of such a driving mechanism is complicated, which resultantly raises production cost of the apparatus.

SUMMARY OF THE INVENTION

In view of the above, it is an object of the invention to provide an image forming apparatus free from the problems residing in the prior art. It is a further object of this invention to provide an image forming apparatus equipped with a mechanism that enables to move a sheet separator in an axial direction of a roller without providing a drive source dedicatedly used for moving the sheet separator and with a simplified construction to thereby reduce production cost of the apparatus.

According to an aspect of this invention, an image forming apparatus comprises a pair of fixing rollers which are rotated to fix an image on a sheet; a sheet separator which is rendered into contact with at least one of the fixing rollers to separate the sheet from the roller; and drive means which converts a driving force of a drive source for rotating the fixing roller or a transport roller disposed downstream in a sheet transport direction with respect to the fixing roller pair to a driving force in an axial direction of the fixing roller so as to reciprocate the sheet separator in the axial direction of the fixing roller.

In this arrangement, utilizing the driving force of the drive source for rotating the fixing roller or the transport roller enables to reciprocate the sheet separator in the axial direction of the roller. This arrangement eliminates necessity of providing an additional drive source for reciprocating the sheet separator. Thus, this arrangement simplifies the construction of reciprocating the sheet separator in the axial direction of the roller while reducing production cost of the apparatus.

These and other objects, features and advantages of the present invention will become more apparent upon a reading of the following detailed description and accompanying drawing.

DETAILED DESCRIPTION OF THE PREFERRED EMBODIMENTS OF THE INVENTION

Hereinafter, an embodiment of this invention is described with reference to the accompanying drawings. An image forming apparatus, as an embodiment of this invention, is provided with a link mechanism operated in association with a sheet separator device which is adapted to separate a sheet from a roller of a fixing device. The sheet separator device is mounted with a thrust driving mechanism for moving the sheet separator device in an axial direction of the roller.

Figure 1:
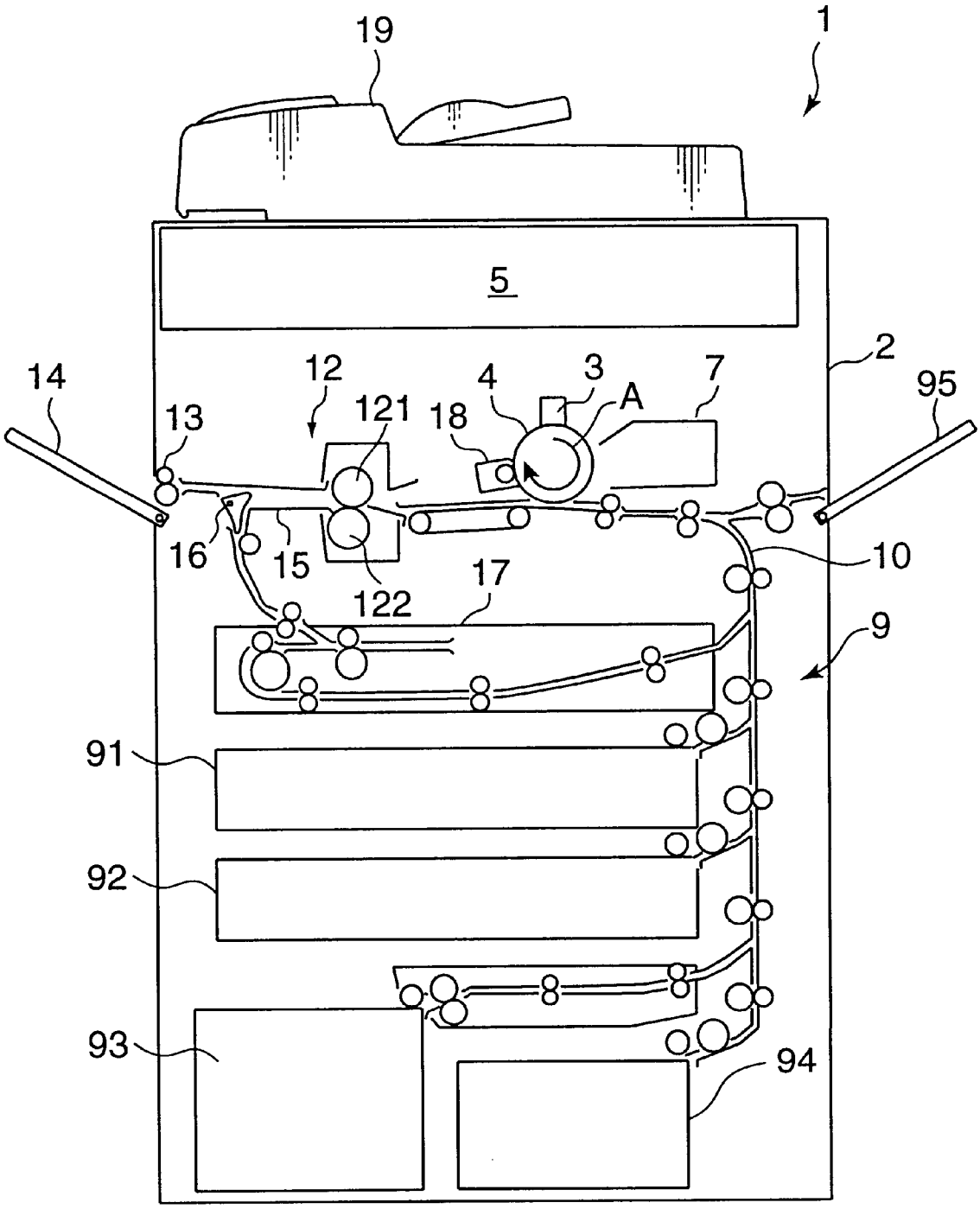
FIG. 1 is a diagram schematically showing an arrangement of an image forming apparatus in accordance with this invention.

First, an overall construction of the image forming apparatus of this invention is briefly described with reference to FIG. 1. FIG. 1 is a diagram showing a schematic arrangement of the image forming apparatus (in this embodiment, a copier) in accordance with this invention. As shown in FIG. 1, the copier 1 is constructed in such a manner that a photosensitive drum 4 which is adapted to rotate in a direction of the arrow A in FIG. 1 is charged uniformly by a charger 3, an electrostatic latent image is formed on the surface of the photosensitive drum 4 by a laser beam emitted from a laser scanner unit (not shown) based on a document image read by a document reader 5, and the latent image is developed into a toner image by adhering toner onto the latent image by a developer 7.

As timed with the above image development, a copy sheet is transported from a sheet cassette section 9 toward the photosensitive drum 4 on which a toner image is formed via a sheet transport path 10, and the toner image is transferred from the drum surface onto the copy sheet. The sheet carrying the transferred toner image is separated from the drum surface and is transported to a fixing device 12 provided with a heater roller 121 and a presser roller 122, whereby the toner image is fixed onto the sheet for image formation. The sheet after the image formation (namely, after passing a nipped portion defined by the heater roller 121 and the presser roller 122) is directly discharged onto a discharge section 14 by a discharge roller pair 13 or is discharged onto the discharge section 14 after a double-sided image formation, which is implemented as follows. Specifically, for a double-sided image formation, a sheet after an image formation on one surface thereof is transported along a sheet transport path 15 toward a switchback section 17. Upon reaching the switchback section 17, the sheet has its transport direction inverted by a switching member 16, and is transported again toward the photosensitive drum 4 along a predetermined transport path in the switchback section 17 and the sheet transport path 10. Then, the sheet has a toner image transferred onto the opposite surface thereof at a predetermined transfer position on the photosensitive drum 4, and is discharged onto the discharge section 14.

Reference numeral 18 denotes a cleaning section to remove toner residues or the like on the photosensitive drum 4. 19 denotes a document feeder which feeds a document to the document reader 5 for reading a document image. The sheet cassette mechanism 9 is detachably mounted on a main body 2 of the copier 1, and includes sheet cassettes 91, 92, 93, 94 each adapted for accommodating a stack of sheets therein, and a sheet feeder tray 95 provided above the sheet cassettes 91 to 94. The sheet cassettes 91 to 94, and the sheet feeder tray 95 are each communicated to the developer 7 and the photosensitive drum 4 by way of the sheet transport path 10.

The fixing device 12 is, although not illustrated in FIG. 1, provided with a sheet separator device including a separator member or members rendered into contact with the surface of the heater roller 121 to separate a sheet from the heater roller 121. The separator member has such a construction as to reciprocate linearly in an axial direction of the heater roller 121 while being rendered in contact with the surface of the heater roller 121. This arrangement is a primary feature of this invention, which is described later in detail. Likewise, a separator member is provided on the surface of the presser roller 122 in the similar manner as the separator member of the heater roller 121.

Figure 2:
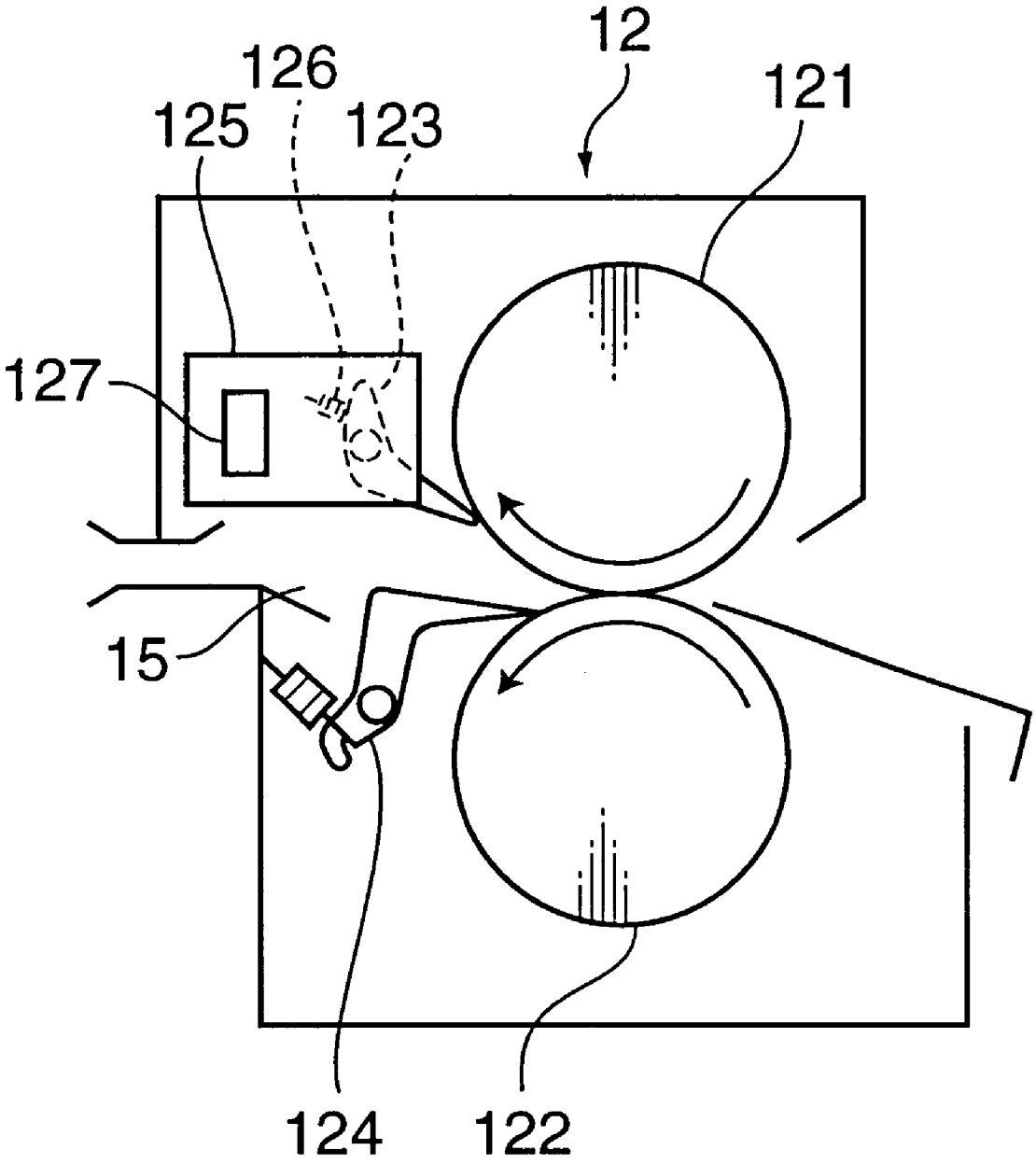
FIG. 2 is a side view schematically showing an arrangement of a fixing device of the image forming apparatus of this invention.

Next, the arrangement of the fixing device 12 is described. FIG. 2 is a side view schematically showing an arrangement of the fixing device 12. The fixing device 12 includes a fixing roller pair consisting of the heater roller 121 built with a heater therein and the presser roller 122 in pressing contact with the heater roller 121. A group of the separator members 123 (see FIG. 3A; hereinafter also referred o as a separator or a sheet separator) are provided on the heater roller 121 (presser roller 122) to keep a sheet from undesirably winding on the roller 121 (122). The heater roller 121 and the presser roller 122 rotate in the directions shown by the respective arrows in FIG. 2. A sheet carrying a transferred toner image after passing the photosensitive drum 4 passes a clearance defined by the heater roller 121 and the presser roller 122 while being nipped by a nipped portion of the heater roller 121 and the presser roller 122, whereby the toner image is fixed onto the sheet due to heat/press operation by the rollers 121, 122.

A guide member 125 is provided downstream in the sheet transport direction with respect to the fixing roller pair to guide a sheet after passing the fixing roller pair along the predetermined sheet transport direction. A lower portion of the guide member 125 constitutes a part of the sheet transport path 15. Each separator member 123 for the heater roller 121 is pivotally supported on the guide member 125 about an axis of rotation thereof. The separator member 123 is so designed that a lead end thereof comes into pressing contact with the heater roller 121 at a certain contact pressure by a biasing force of a spring attached on the guide member 125. A contact portion 127 is formed at an axial end of the guide member 125 to come into contact with an eccentric cam 152*b*, which is described later. The guide member 125 is so constructed as to move in the axial direction of the heater roller 121 as the contact portion 127 is being pressed by the eccentric cam 152*b* in accordance with a rotation of the eccentric cam 152*b*. The operation of the thrust movement of the guide member 125 is described later in detail.

Figure 3A:
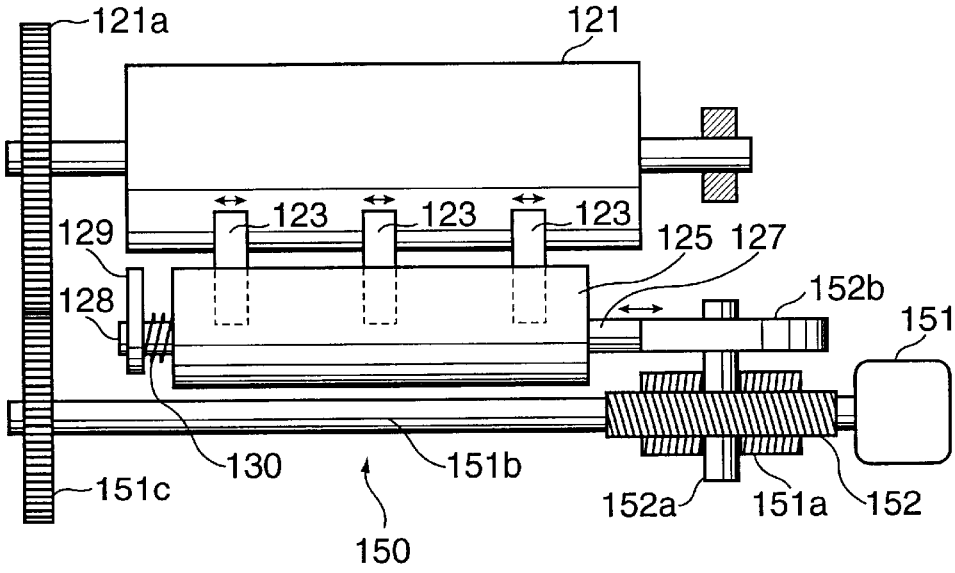
FIG. 3A is a plan view showing sheet separators, a guide member, and a thrust driving mechanism for transversely moving the sheet separator members and the guide member in the image forming apparatus of this invention.
Figure 3B:
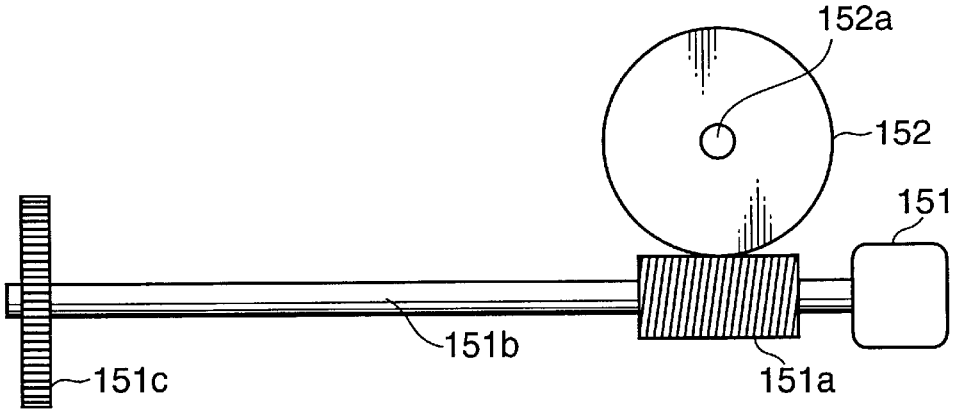
FIG. 3B is a side view showing a gear mechanism constituting the thrust driving mechanism used in the image forming apparatus of this invention.
Figure 3C:
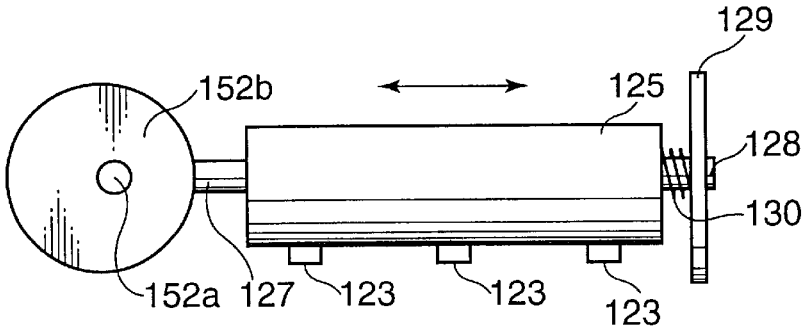
FIG. 3C is a side view showing an eccentric cam of the thrust driving mechanism and the guide member.

Now, a thrust driving mechanism for moving the separator members 123 and the guide member 125 in the axial direction of the heater roller 121 is described. FIG. 3A is a plan view showing the separator members, the guide member, and the thrust driving mechanism. FIG. 3B is a side view showing a gear arrangement constituting the thrust driving mechanism. FIG. 3C is a side view showing the guide member, and the eccentric cam of the thrust driving mechanism.

The thrust driving mechanism 150 for transversely moving the separator members 123 and the guide member 125 includes a worm gear 151*a* provided around a rotary shaft 151*b* for turning a fixing roller turning knob 151, a helical gear 152 which serves as a worm wheel and is meshed with the worm gear 151*a,* and the eccentric cam 152*b* coaxially mounted on a rotary shaft 152*a* of the helical gear 152. The guide member 125 includes a protrusion 128 provided at the axially end portion thereof which is opposite to the one end portion thereof where the contact portion 127 is formed. The protrusion 128 is fittingly supported in a through hole (not shown) of a side wall of a housing (hereinafter also referred to as "a support plate 129") of the fixing device 12 to be slidable in and out of the support plate 129. A spring 130 is mounted on the protrusion 128 to urge the guide member 125 toward the eccentric cam 152*b* (in the rightward direction in FIG. 3A). Hereinafter the spring 130 is also referred to as a compressed spring, i.e., when it is mounted the spring is usually maintained in a compressed state so that it always generate a biasing force in an axially outward direction. In other words, the spring 130 is maintained shorter than its free length.

A gear 151*c* mounted on the rotary shaft 151*b* is meshed with a rotary driving gear 121*a* of the heater roller 121. Manually turning the knob 151 enables to rotate the heater roller 121 in association with turning of the knob 151. Also, the knob 151 is rotatable by a drive source. Specifically, when the heater roller 121 is rotated by a drive source (not shown) engaged with the rotary driving gear 121*a,* the knob 151 is rotatable by engagement of the rotary driving gear 121*a* with the gear 151*c*.

The helical gear 152 is, as shown in FIG. 3B, mounted at such a position on the rotary shaft 151*b* as to mesh with an upper portion of the worm gear 151*a*. The eccentric cam 152*b* is provided at such a position on the rotary shaft 152*a* of the helical gear 152 that a side part thereof comes into contact with the contact portion 127 of the guide member 125. The eccentric cam 152*b* rotates with the side part thereof in sliding contact with the contact portion 127.

In the above arrangement, in the case where the heater roller 121 is rotated in synchronism with fixing a transferred toner image, for example, the knob 151 and the worm gear 151*a* are rotated in accordance with the rotation of the heater roller 121, and accordingly, the helical gear 152 in mesh with the worm gear 151*a* is rotated in accordance with the rotation of the heater roller 121. As the helical gear 152 is rotated, the eccentric cam 152*b* coaxially mounted on the rotary shaft 152*a* is rotated. Thereby, the side part of the eccentric cam 152*b* pressingly comes into contact with the contact portion 127 of the guide member 125, and the guide member 125 and the separator members 123 are reciprocated in the directions of the arrows in FIGS. 3A (namely, in the axial direction of the heater roller 121 shown by the arrows in FIG. 3C) in conformance with the configuration of the eccentric cam 152*b*. Specifically, a rotary driving force of the drive source to rotate the heater roller 121 is converted into a linear driving force in the axial direction of the heater roller 121. In this way, the separator members 123 are reciprocated in the axial direction of the heater roller 121 due to the converted driving force. With this arrangement, as the heater roller 121 is rotated, the separator members 123 are transversely reciprocated relative to the heater roller 121 to thereby shorten a period for contacting the separator members 123 with the surface of the heater roller 121 at the same location thereon.

In the aforementioned arrangement, in the case where the separator members 123 are reciprocated in the axial direction of the heater roller 121 by the driving force of the drive source for rotating the heater roller 121, a remarkable speed reduction ratio is obtainable when the driving force of the drive source for the heater roller 121 is about to be transmitted from the worm gear 151*a* to the helical gear 152. Further, changing a gear ratio of the worm gear 151*a* to the helical gear 152 or a gear ratio of the rotary driving gear 121*a* to the gear 151*c* enables to optimally alter a relation between a period necessary for reciprocating the separator members 123 and a circumferential traveling distance of the heater roller 121 which is obtained by multiplying a peripheral velocity of the heater roller 121 by one cycle for reciprocating the separator member 123.

Figure 4:
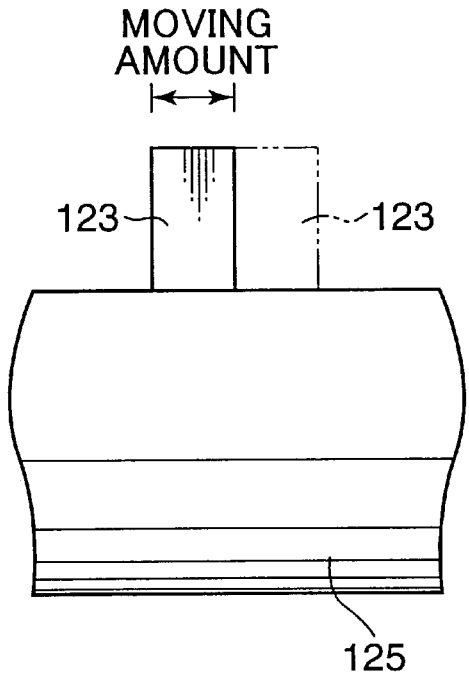
FIG. 4 is a diagram showing a moving amount of the sheet separator member.
Figure 5:
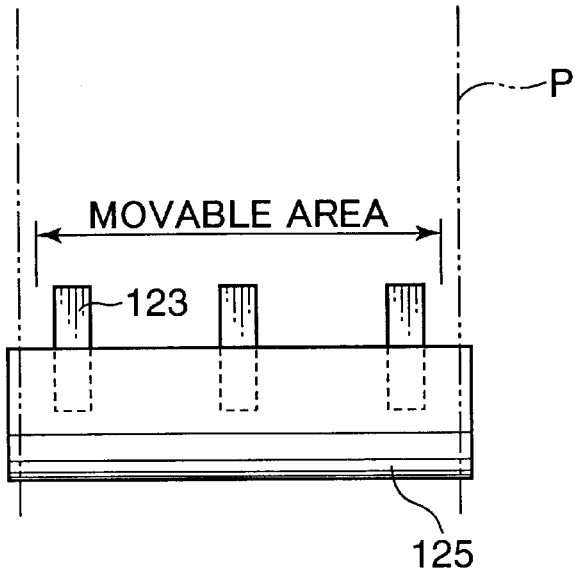
FIG. 5 is a diagram showing a movable range of the sheet separator members relative to a copy sheet.

Next, the thrust movement of the separator member 123 is described. FIG. 4 is a diagram showing a moving amount of the separator member 123. FIG. 5 is a diagram showing a movable range of the separator member 123 relative to a copy sheet P. As shown in FIG. 4, preferably, the moving amount of the separator member 123 by the thrust driving mechanism may be not smaller than the width of the separator member 123 in the axial direction of the heater roller 121. In view of this, the eccentric cam 152*b* has such a configuration as to allow the rotary shaft 152*a* to rotate the eccentric cam 152*b* eccentrically so as to transversely reciprocate the separator member 123 at a moving amount equal to or larger than the width of the separator member 123. As shown in FIG. 5, the guide member 125 and the separator members 123 are positioned relative to the heater roller 121 so as to reciprocate an outermost pair of the separator members 123 within a range corresponding to the width of the sheet P, considering the width of the sheet P which is transported to the fixing device 12.

Thus, transversely reciprocating each of the separator members 123 at a moving amount equal to or larger than the width thereof enables to securely remove toner particles intruded in a space between the separator members 123 and the surface of the heater roller 121 and shorten a contact period of the separator members 123 with the surface of the heater roller 121 at the same location. In addition, setting the movable range of the separator members 123 within a range corresponding to the width of the sheet P enables to transversely reciprocate each separator member 123 without impairing an inherent function of the separator member 123 to separate a sheet P from the heater roller 121 without a likelihood that the sheet P may be wound around the heater roller 121.

A relation between an angular displacement of the heater roller 121 and a cycle for reciprocating the separator member 123 for a thrust movement may preferably satisfy the condition that $0.5\ m \leqq L \leqq 20\ m$ where L is a circumferential traveling distance of the heater roller 121 per cycle for reciprocating the separator member 123 which is obtained by multiplying a peripheral velocity of the heater roller 121 by a cycle for reciprocating the separator member 123. Setting the distance L in the aforementioned range enables to keep the surface of the heater roller 121 from being damaged due to contact with the separator member 123 while avoiding an excessively fast movement of the separator member 123 relative to the heater roller 121. This arrangement is also advantageous in suppressing toner adhesion on a region of the surface of the heater roller 121 that is rendered into contact with the separator members 123.

More preferably, setting the distance L where $1\ m \leqq L \leqq 10\ m$ enables to more securely keep the surface of the heater roller 121 from being damaged due to contact with the separator members 123 and suppress toner adhesion onto the surface of the separator members 123 and the heater roller 121 in contact therewith. For instance, let it be assumed that the width of the separator member 123 is about 2 mm, the moving amount of the separator member 123 for a thrust movement is about 2.4 mm, the peripheral velocity of the heater roller 121 is about 290 mm/s, and the cycle for reciprocating the separator member 123 is about 13 seconds. Then, the distance L of the heater roller 121 per cycle for reciprocating the separator member 123 is about 3.8 m. This arrangement enables to suppress abrasion of the surface of the heater roller 121 and toner adhesion on the surface of the separator members 123 and the heater roller 121 in contact therewith.

As mentioned above, the copier 1 as an embodiment of this invention is constructed in such a manner that the separator members 123 are reciprocated in the axial direction of the heater roller 121 (part of the fixing roller pair) by utilizing the driving force of the drive source for rotating the heater roller 121. This arrangement does not require an additional drive source to reciprocate the separator members 123. Further, this arrangement enables to remove toner that has adhered on the surface of the separator members 123 and the heater roller 121 in contact therewith and prevent occurrence of sheet jam around the separator members 123, as well as simplifying the construction of drive means for driving the separator member 123 and reducing the production cost of the copier 1.

Furthermore, this arrangement provides a large speed reduction ratio when transmitting a driving force of the drive source for rotating the heater roller 121 from the worm gear 151*a* to the helical gear 152 (worm wheel). Accordingly, the driving force of the drive source for rotating the heater roller 121 can be optimally converted to a drive source sufficient for reciprocating the separator members 123. Also, since the separator members 123 are linearly reciprocated in this embodiment, the aforementioned arrangement does not require a thrust bearing, which has been required in the conventional arrangement provided with a solenoid or its equivalent, thereby simplifying the construction of the copier.

In the above embodiment, the separator member 123 is reciprocated by a moving amount equal to or larger than the width of the separator member 123 in the axial direction of the heater roller 121. This arrangement enables to securely shorten the period for contacting the separator member 123 on the surface of the heater roller 121 at the same location. Thereby, this arrangement enables to suppress abrasion of the heater roller 121 due to contact with the separator members 123 and to eliminate a likelihood that toner which has intruded in the space between the surface of the heater roller 121 and the separator members 123 may adhere onto the separator members 123.

It should be appreciated that this invention is not limited to the aforementioned embodiment, and various modifications and alterations are applicable. The following is some of the modifications and alterations.

(1) In the embodiment, the helical gear 152 is used as a worm wheel to be meshed with the worm gear 151*a*. The worm wheel may include a gear other than the helical gear.

(2) In the embodiment, the eccentric cam 152*b* is rotated and rendered into sliding contact with the guide member 125 to transversely move the guide member 125. Alternatively, a cam having an axis of rotation which does not provide eccentric rotation may be used.

(3) In the embodiment, the separator members 123 and the guide member 125 are so constructed as to be transversely reciprocated by utilizing a driving force of a drive source for rotating the heater roller 121. As an altered form, the thrust movement may be provided with use of a driving force of a drive source for the presser roller 122 or a driving force of the drive source for a transport roller provided downstream with respect to the fixing roller pair.

(4) In the embodiment, the separator member 123 is transversely reciprocated in the range equal to or larger than the width thereof. Alternatively, the separator member 123 may be transversely reciprocated in a range smaller than the width thereof.

(5) The parameters such as the cycle for reciprocating the separator members 123 and the movable range of the separator members 123 may be optimally changed according to needs.

(6) In the foregoing embodiment, the thrust driving mechanism 150 transversely reciprocates the separator members 123 provided on the heater roller 121. Alternatively, such a thrust driving mechanism may be applicable to transversely reciprocate the separator member (s) provided on the presser roller 122 (the other one of the fixing roller pair), or a separator member or its equivalent provided on a roller other than the heater roller 121 that is provided around the photo sensitive drum 4.

Now, a link mechanism for retracting the separator members 123 and the guide member 125 away from the heater roller 121 in association with opening the sheet transport path 15 is described with reference to FIGS. 6 through 9. FIGS. 6 through 9 each shows a link mechanism that is not equipped with the thrust driving mechanism 150.

Figure 6:
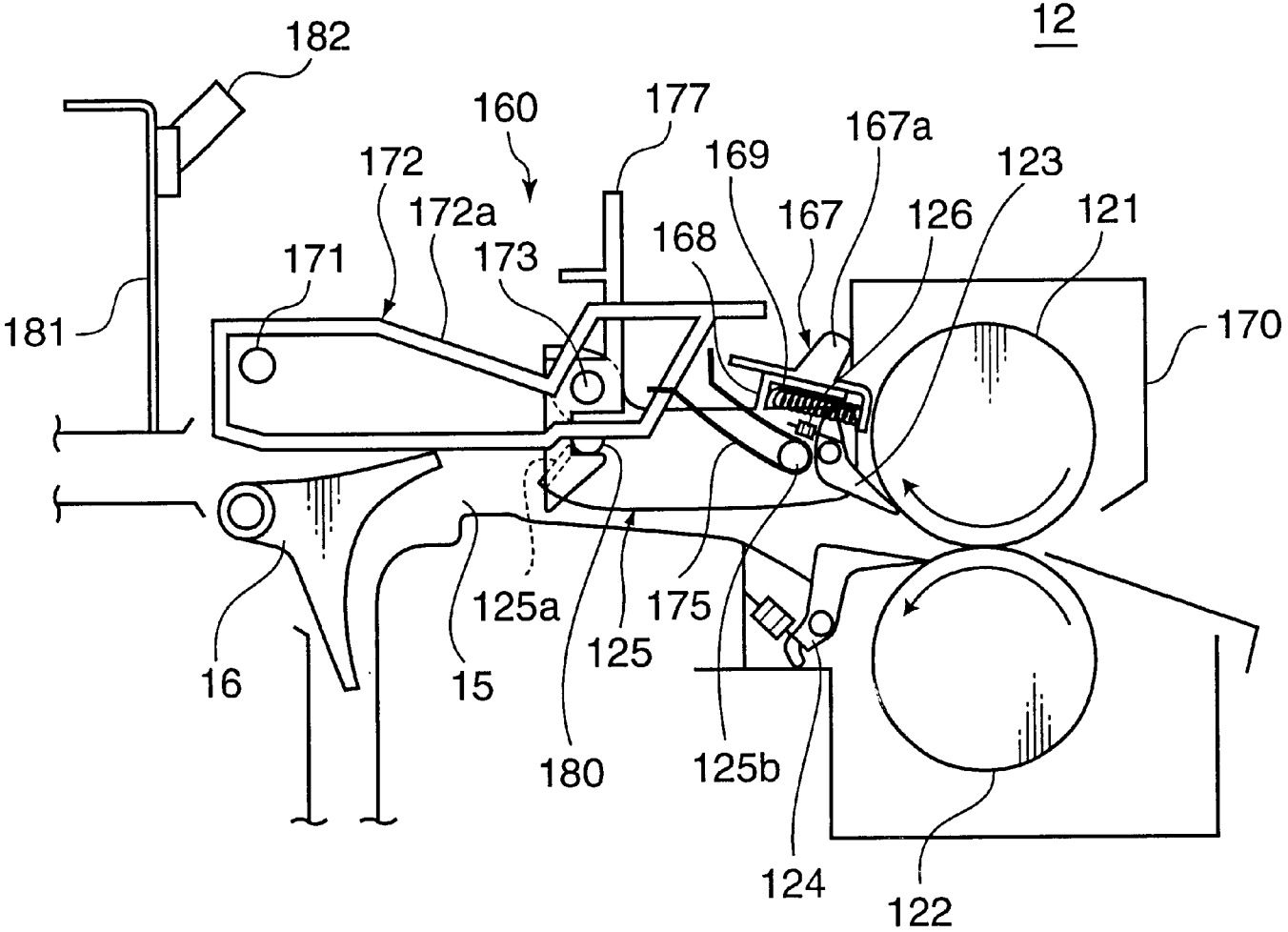
FIG. 6 is a side view showing a schematic arrangement of a link mechanism for operatively retracting the sheet separator member from a heater roller of the fixing device so as to expose a sheet transport path provided downstream in a sheet transport direction with respect to the fixing device.

FIG. 6 is a side view schematically showing an arrangement of the link mechanism for retracting the separator members 123 and the guide member 125 from the heater roller 121 in such a direction as to expose the sheet transport path 15. Although the link mechanism is equipped with the thrust driving mechanism 150, in this section, simply the link mechanism that is not equipped with the thrust driving mechanism 150 is described with reference to FIGS. 6 through 9 in order to clarify the arrangement and the operation of the link mechanism.

As mentioned above, the lower portion of the guide member 125 provided downstream with respect to the fixing roller pair and the guide fixing portion constitute the sheet transport path 15 when the guide member 125 is set substantially horizontal, as shown in FIG. 6. The separator members 123 for separating a sheet from the heater roll 121 are rotatably mounted on a side portion of the guide member 125. A cover member 167 is provided on an upper portion of the guide member 125 to shield and protect the separator members 123. The cover member 167 is slidably mounted on a guide portion 168 formed at a top portion of the guide member 125 and is urged in such a direction as to be away from the guide member 125 (in the rightward direction in FIG. 6) by a spring 169. Where the spring 169 is usually maintained in a compressed state so that it always generates a biasing force in an axially outward direction. A projection 167*a* is formed at a top portion of the cover member 167. Abutting the projection 167*a* against a fixing roller cover 170 urges the cover member 167 toward the guide member 125 against the biasing force of the spring 169. Thereby, the separator members 123 are projected out of a casing of the guide member 125 and come into contact with the heater roller 121.

Figure 7:
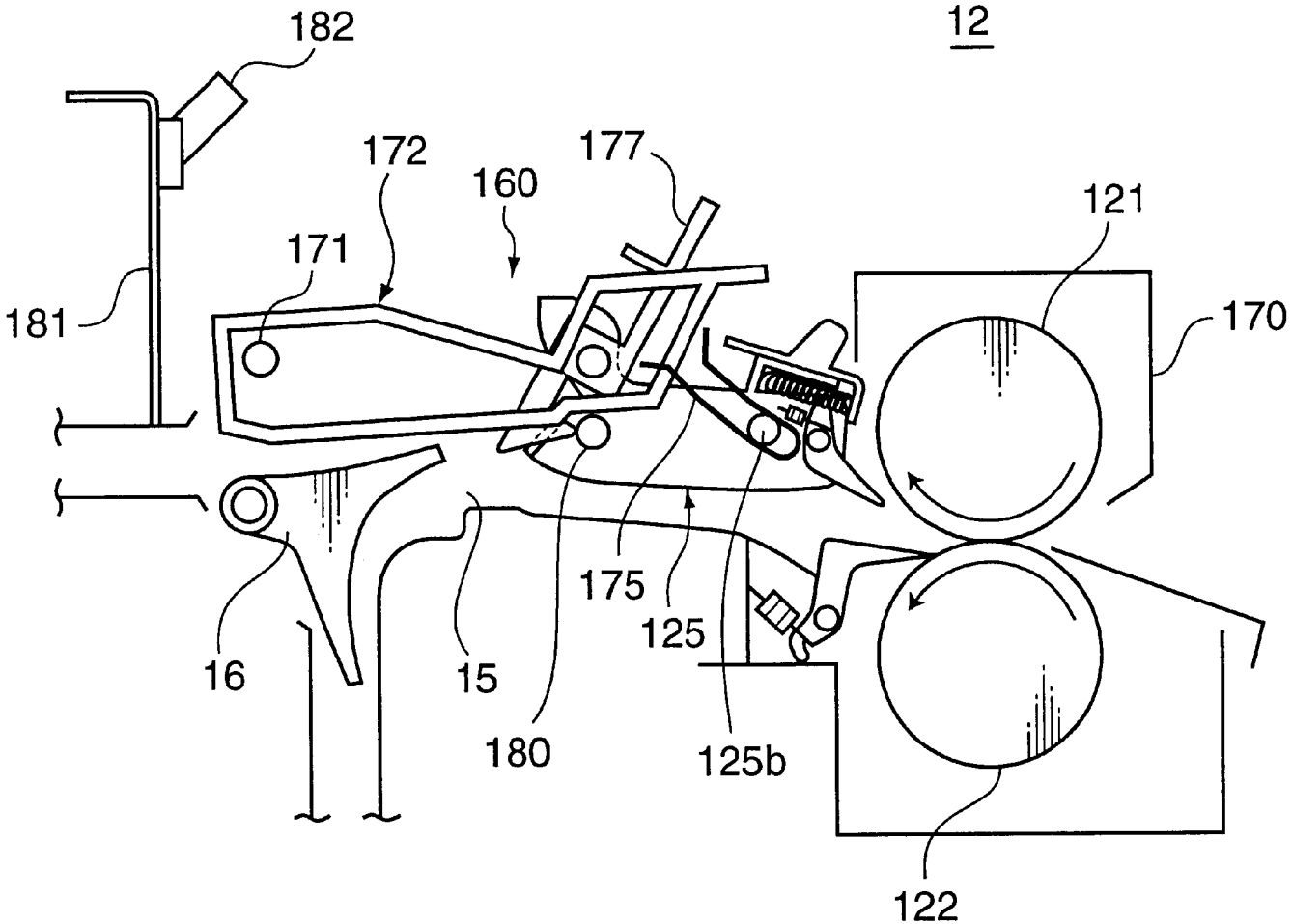
FIG. 7 is a diagram illustrating how the guide member and a support member are operated in the link mechanism.

A support member 172 is pivotally mounted on side wall of a housing of the fixing device 12 (not shown, hereinafter, referred to as "housing wall") about an axis of a support shaft 171. The guide member 125 is pivotally mounted on the support member 172. The support member 172 and the guide member 125 constitute the link mechanism 160. When the support member 172 is angularly displaced in a counterclockwise direction in FIG. 6, the guide member 125 is pivotally moved in the same direction as the support member 172, as shown in FIG. 7. The counterclockwise angular displacement of the support member 172 moves the guide member 125 away from the guide fixing portion to thereby expose the sheet transport path 15.

As shown in FIG. 6, the guide member 125 is pivotally mounted on the support member 172 about an axis of rotation of a support shaft 173. The guide member 125 is pivotable to such an extent that a contact portion 125*a* formed on the guide member 125 is abutted against an inner wall 172*a* of the support member 172. A pin 125*b* is provided on a side portion of the guide member 125, and is engaged with a guide rail 175 provided on the housing wall of the fixing device 12. Engagement of the pin 125*b* with the guide rail 175 regulates the posture of the guide member 125 relative to the support member 172 in association with open/close operations of the link mechanism 160 (see FIGS. 6 and 8). Changing the direction of guiding the pin 125*b* along the guide rail 175 enables to optimally regulate the posture of the guide member 125 when the link mechanism 160 is being operated.

A stopper member 177 is provided on the support member 172 to retain the support member 172 and the guide member 125 at respective retained postures relative to the guide fixing portion. The stopper member 177 is provided on the support member 172 to be coaxially rotatable with the guide member 125 about the axis of the support shaft 173. The stopper member 177 has such a configuration as to be engageable with a pin 180 provided on the housing wall of the fixing device 12. Pivotally rotating the stopper member 177 about the axis of the support shaft 173 to such a direction as to be engaged with or disengaged from the pin 180 selectively positions the guide member 125 relative to the guide fixing portion or releases its positioning.

A side wall 181 of the housing of the fixing device 12 located on a left upper portion of the support member 172 in FIGS. 6 through 9 (hereinafter, referred to as "housing wall 181") is formed with a retaining portion 182 which is abutted against the contact portion 125*a* of the guide member 125 when the guide member 125 is moved away from the guide fixing portion and is set at an opened posture in which the guide member 125 extends in a direction generally orthogonal to the sheet transport direction. A hole (not shown) is formed in the support member 172 at such a position and with such a configuration as to correspond to the retaining portion 182. Fittingly inserting the retaining portion 182 in the hole of the support member 172 enables to engage the contact portion 125*a* with the retaining member 182.

Figure 8:
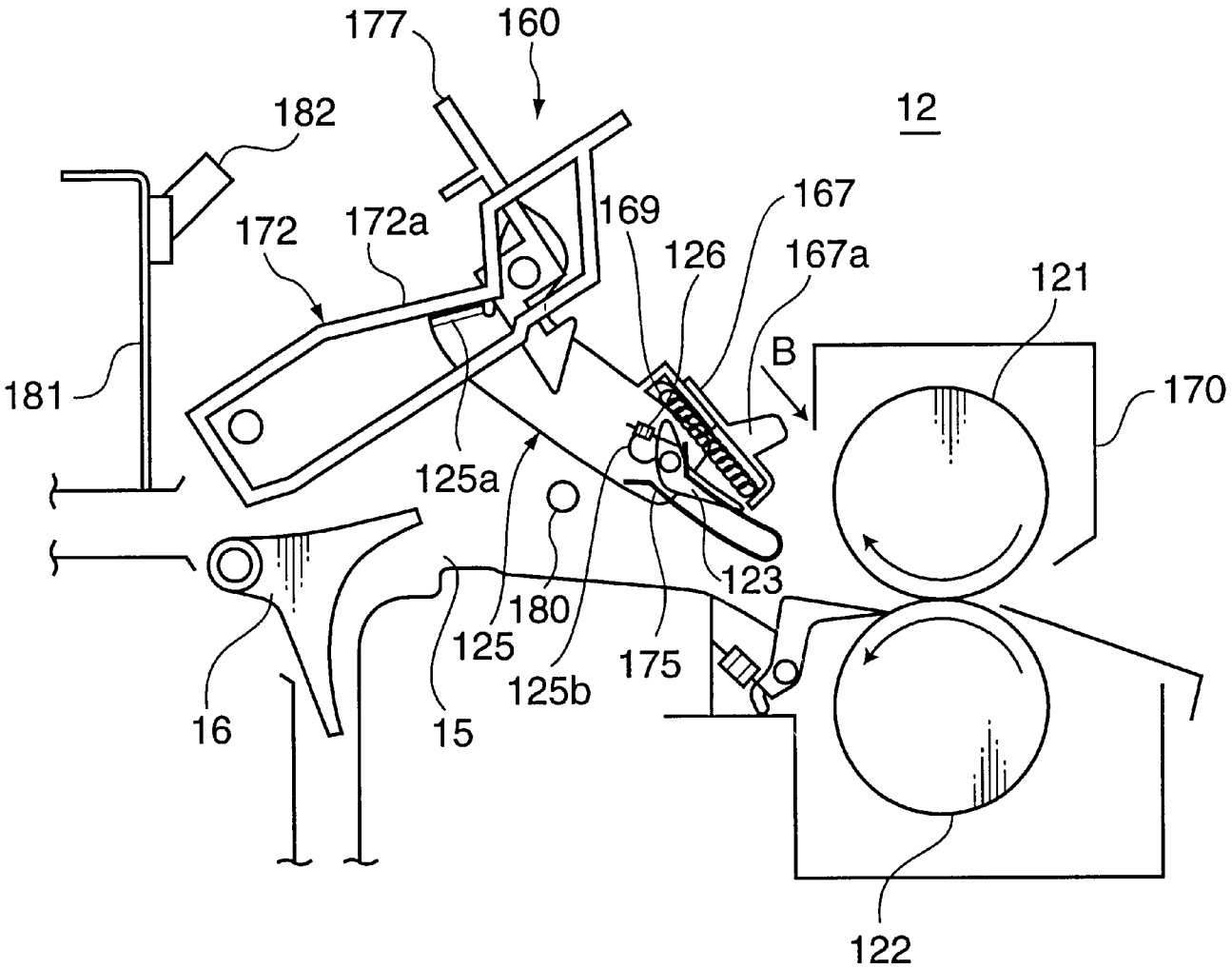
FIG. 8 is a diagram illustrating how the guide member and the support member are operated in the link mechanism.
Figure 9:
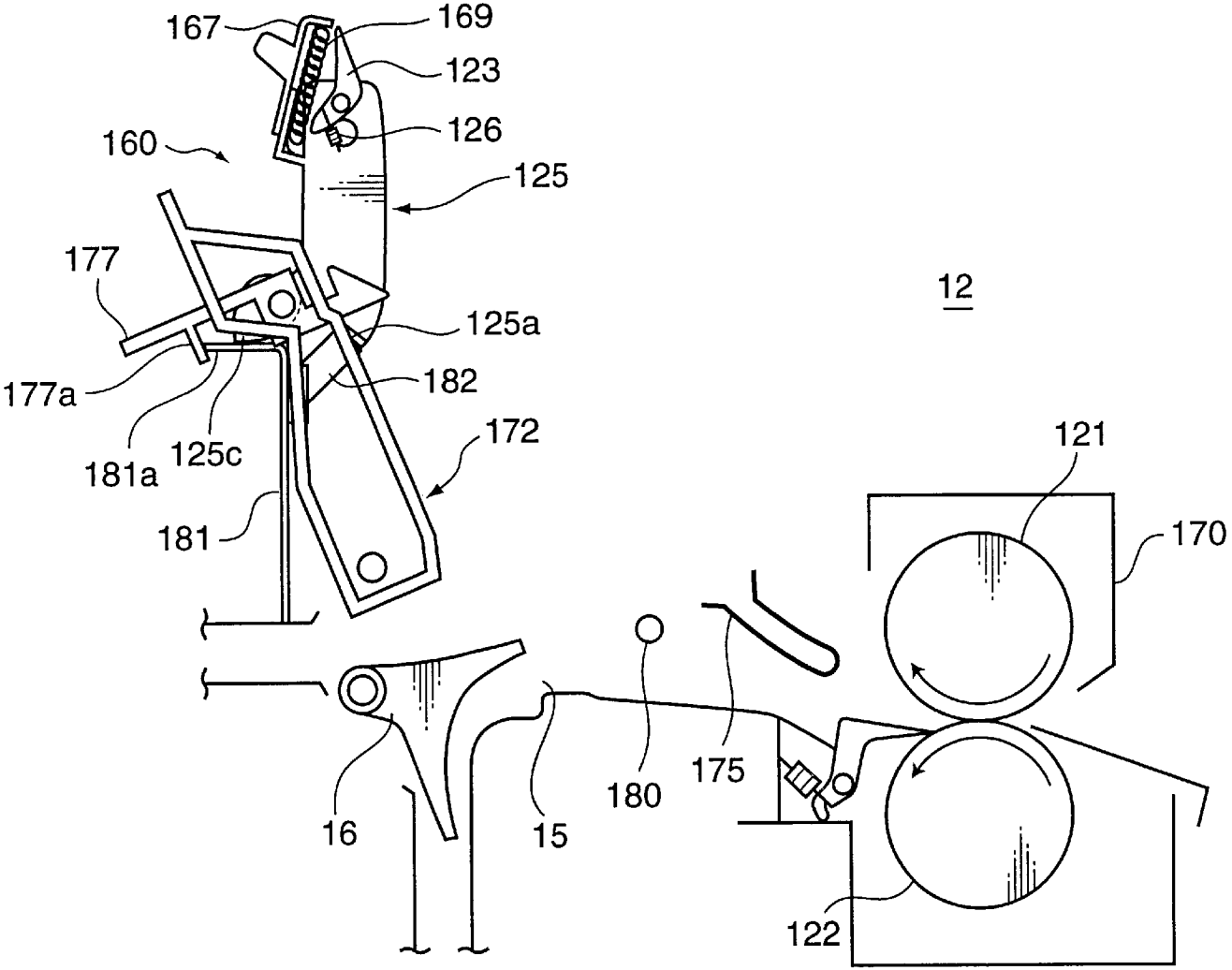
FIG. 9 is a diagram of the link mechanism in a state that the guide member and the support member are engaged with a housing of a main body of the image forming apparatus.

Next, described are operations as to how the guide member 125 and the support member 172 are operated in association with operations of the link mechanism 160. FIGS. 7 and 8 are diagrams illustrating states of the guide member 125 and the support member 172 when the link mechanism 160 is on the way of moving the guide member 125 and the separator members 123 toward and away from the guide fixing portion. FIG. 9 is a diagram showing a state that the guide member 125 and the support member 172 are engaged with the housing wall 181 of the fixing device 12.

In order to render the sheet transport path 15 accessible for an operator to remove a jammed sheet or the like, first, the operator withdraws the fixing device 12 in a forward direction of the main body of the copier 1 (frame of an image forming apparatus). Then, pivotally rotating the stopper member 177 clockwise in FIG. 6 disengages the stopper member 177 from the pin 180, as shown in FIG. 7. As a result, the operator is allowed to pivotally rotate the support member 172 upward in counterclockwise direction, whereby the guide member 125 is moved away from the guide fixing portion to expose the sheet transport path 15. When the support member 172 is pivotally rotated upward, the guide member 125 is gradually moved away from the guide fixing portion while defining a generally L-shape with the support member 172 (see FIG. 8), as the pin 125*b* is guided along the guide rail 175.

As shown in FIG. 8, when the guide member 125 is moved upward away from the guide fixing portion accompanied by the pivotal rotation of the support member 172, and the pin 125*b* is disengaged from the guide rail 175, the guide member 125 is released from the regulating operation by the guide rail 175. Upon disengagement of the pin 125*b* from the guide rail 175, the guide member 125 is pivotally rotatable clockwise in FIG. 8 until the contact portion 125*a* of the guide member 125 is abutted against the inner wall 172*a* of the support member 172. Abutment of the contact portion 125*a* with the inner wall 172*a* positions the guide member 125 relative to the support member 172. At this time, the abutment of the projection 167*a* against the fixing roller cover 170 is released, and the cover member 167 of the guide member 125 slides in such a direction as to cover the separator members 123 (in the direction of the arrow B in FIG. 8) by the urging force of the spring 169. Simultaneously, the separator members 123 are retracted away from the heater roller 121 while pivotally rotating counterclockwise in FIG. 8 by the urging force of a spring 126. Where the spring 126 is maintained in a stretched state so that the spring 126 generates a bias force acting in a direction to shrink its own length.

As the support member 172 is rotated further counterclockwise, as shown in FIG. 9, the support member 172 comes into contact with the housing wall 181 of the fixing device 12, thereby halting the pivotal rotation of the support member 172 there at. At this time, the retaining portion 182 is abutted against the contact portion 125*a* of the guide member 125 by way of the through hole formed in the support member 172, whereby the guide member 125 is held at the opened posture in which the guide member 125 extends generally orthogonal to the sheet transport path 15. When the guide member 125 is set at the opened posture, a lead end portion 125*c* of the guide member 125 comes into contact with a horizontal extension (or a side end portion 181*a*) of the housing wall 181 of the fixing device 12, thereby securely retaining the opened posture of the guide member 125.

At this time, a projection 177*a* of the stopper member 177 is abutted against the side end portion 181*a* of the housing wall 181 of the fixing device 12. Abutment of the projection 177*a* against the side end portion 181*a* positions the support member 172 in such a state as to keep the support member 172 from tilting toward the guide fixing portion. In this arrangement, the guide member 125 is set to the opened posture in which the guide member 125 extends generally orthogonal to the sheet transport path 15 while retaining the support member 172 relative to the housing wall 181 of the fixing device 12. Accordingly, this arrangement enables to secure a large space for removing a jammed sheet or the like while keeping the support member 172 at the retained posture, as shown in FIG. 9, thereby providing improved safety measure in operation such as jammed sheet removal while enhancing operability. Further, as mentioned above, each separator member 123 is pivotable against the urging force of the spring 126, and the cover member 167 is slidable in such a direction as to cover the separator members 123 by the urging force of the spring 169. In this arrangement, the lead end portions of the separator members 123 are covered by the cover member 167, thereby providing further improved safety measure in operation such as jammed sheet removal and preventing the separator members 123 from being damaged or broken.

In the case where the link mechanism 160 is closed (i.e., the sheet transport path 15 is closed), the abutment of the stopper member 177 against the side end portion 181*a* of the housing wall 181 of the fixing device 12 is released, and the support member 172 is rotated clockwise in FIG. 9. As the contact portion 125*a* of the guide member 125 is moved away from the retaining portion 182 accompanied by the pivotal rotation of the support member 172, and the pin 125*b* of the guide member 125 is engaged with the guide rail 175 again, the guide member 125 is gradually shifted from the opened posture to the state as shown in FIG. 7 in which the guide member 125 is set generally horizontally relative to the support member 172. Finally, the separator members 123 are rendered in contact with the heater roller 121, as shown in FIG. 6. Engaging the stopper member 177 with the pin 180 upon verifying that the lower portion of the guide member 125 constitutes part of the sheet transport path 15 enables to position the support member 172 and the guide member 125 relative to the guide fixing portion. Thereby, the sheet transport path 15 is closed, and the fixing device 12 is rendered operative for image fixation.

In the aforementioned section, this invention has been described to the case where the link mechanism 160 has been provided to the fixing roller pair of the fixing device 12. Alternatively, this invention can take the following modifications and alterations.

(1) The link mechanism 160 may be applicable to a separator member provided on the photosensitive drum 4, the document feeder mechanism, a sheet post-processor mechanism, and the like.

(2) The link mechanism 160 may be applicable to a separator member adapted to separate a sheet from a photosensitive belt, a transfer belt, or a sheet transport belt in the case where an image forming apparatus is equipped with such a belt.

(3) The link mechanism 160 may be applicable to a separator member adapted to separate a sheet from a transfer drum and a transfer belt in a color image forming apparatus.

In the foregoing embodiment, the link mechanism 160 includes the guide member 125, the support member 172 and the stopper member 177. Alternatively, the link mechanism 160 may take the following arrangement.

(4) In the embodiment, the stopper member 177 is pivotally rotated coaxially with the guide member 125 about the axis of the support shaft 173. Alternatively, the stopper member 177 may be rotated about an axis of a support shaft other than the support shaft for rotating the guide member 125.

(5) In the embodiment, when the sheet transport path 15 is exposed, the support member 172 is fixed on the housing wall 181 of the fixing device 12 by abutment of the projection 177a of the stopper member 177 against the side end portion 181*a* of the housing wall 181. As an altered arrangement, a member other than the stopper member 177 may be provided to abut against the housing wall 181 so as to engage the support member 172 with the housing wall 181.

(6) In the foregoing embodiment, pivotally rotating the guide member 125, the support member 172, and the stopper member 177 renders the sheet transport path 15 located downstream with respect to the fixing roller pair accessible for an operator. Alternatively,a sheet transport section including a sheet transport roller may be rendered accessible for an operator in the case where such a sheet transport roller is provided on the sheet transport path 15.

Figure 10A:
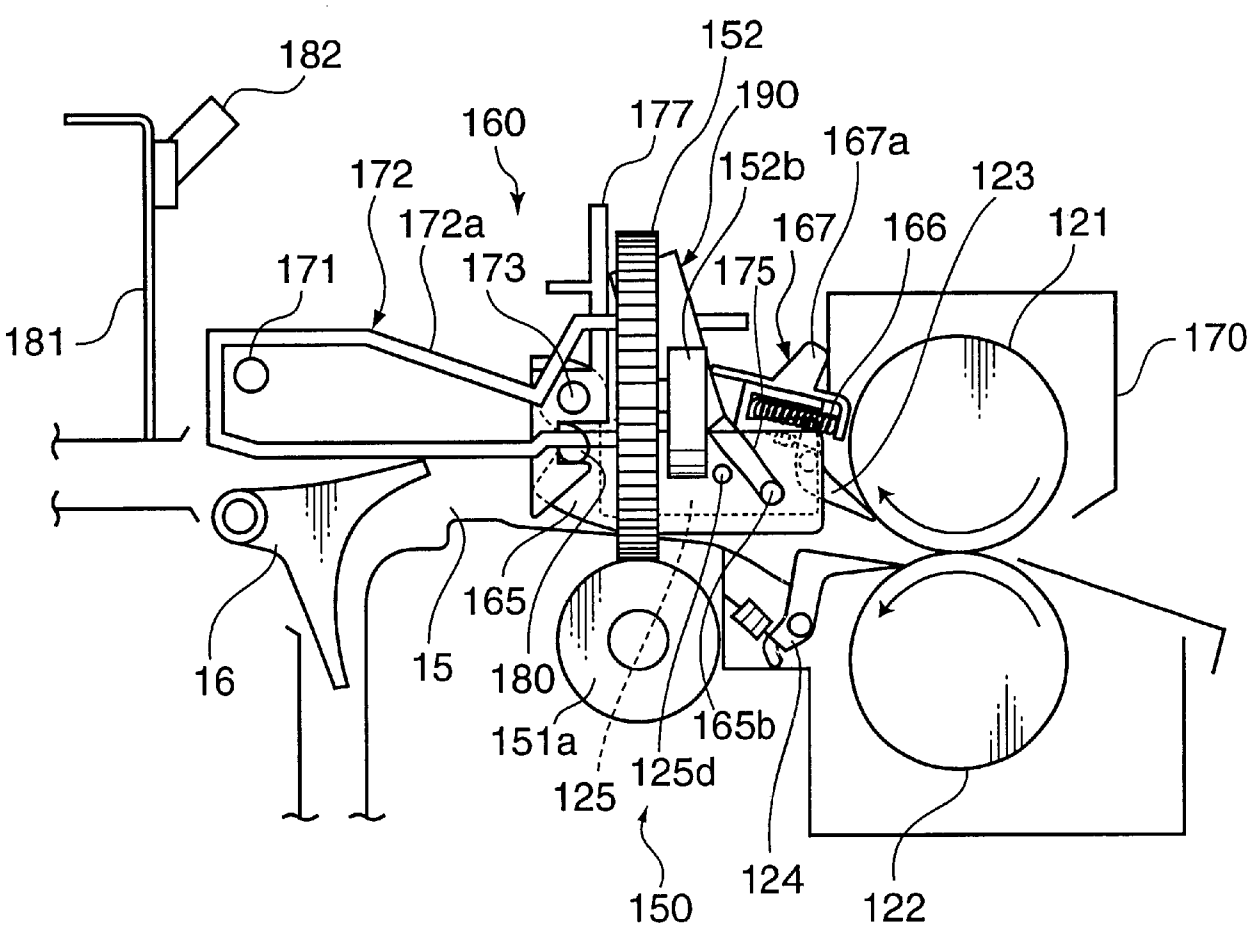
FIG. 10A is a side view schematically showing an arrangement of the link mechanism equipped with the thrust driving mechanism.
Figure 10B:
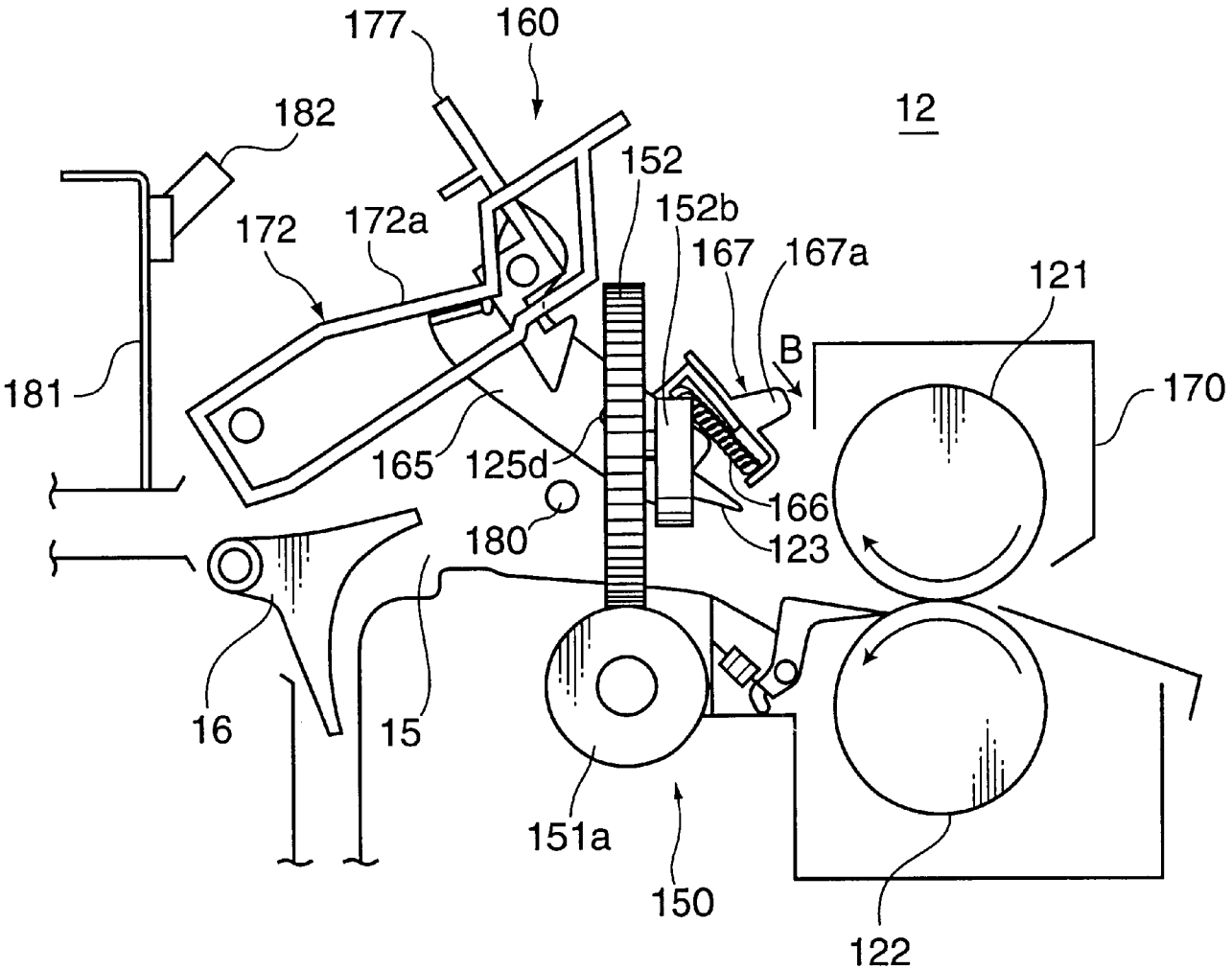
FIG. 10B is a side view similar to FIG. 10A in which a guide member is rotated counterclockwise to open a sheet transport path.
Figure 11A:
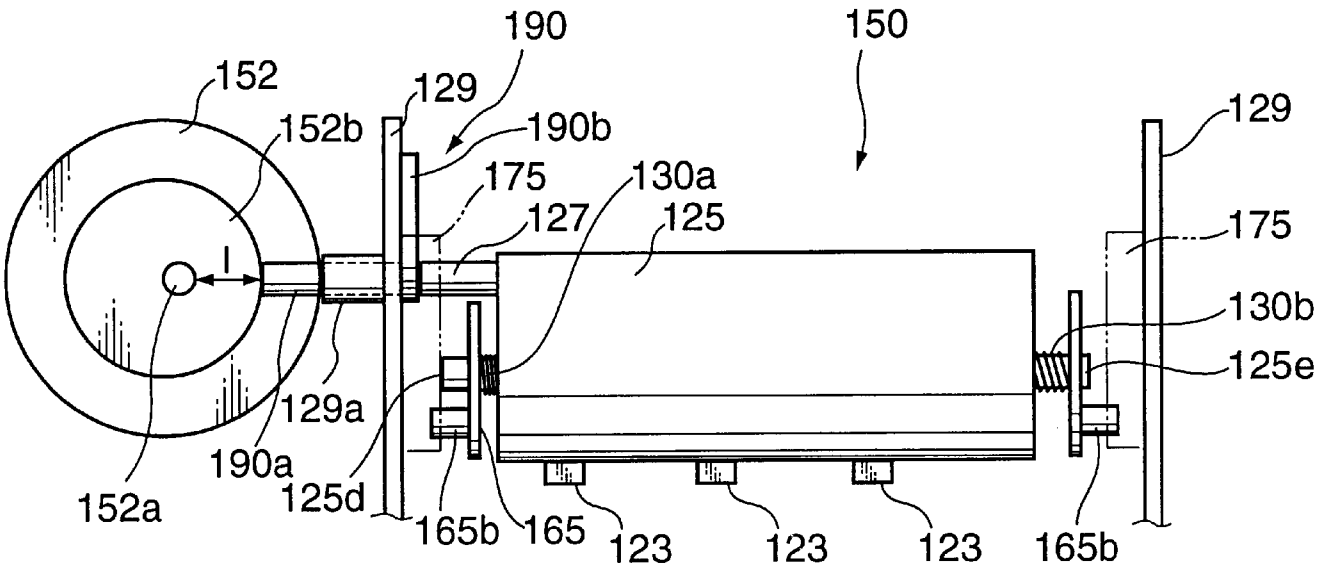
FIG. 11A is a side view schematically showing a thrust movement of the guide member, specifically showing a state that the guide member is released from pressing by an eccentric cam of the thrust driving mechanism.
Figure 11B:
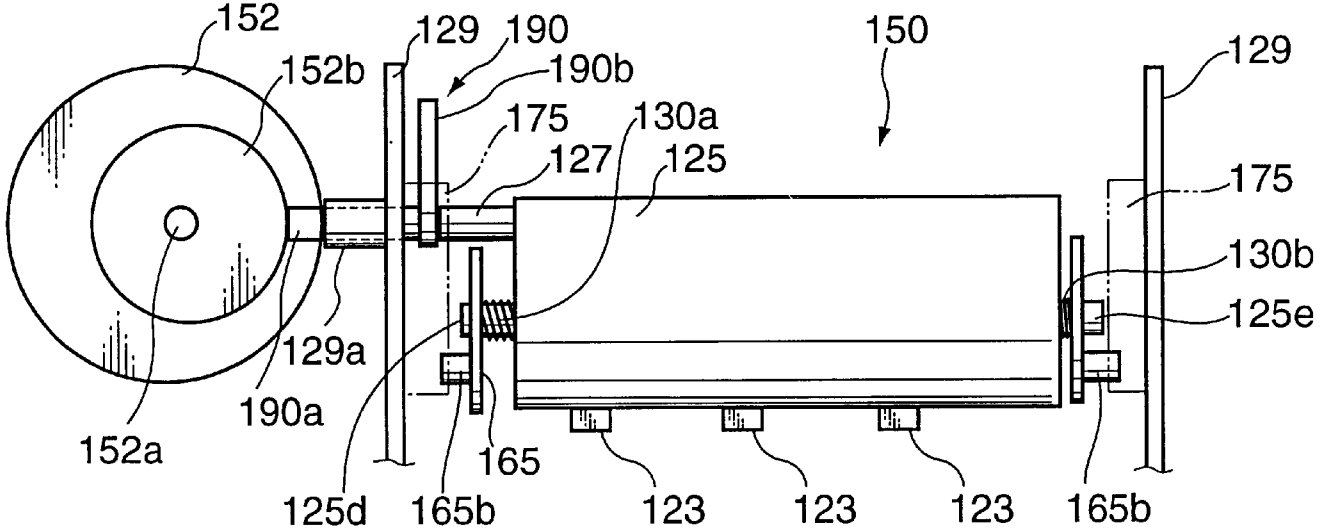
FIG. 11B is a side view schematically showing a thrust movement of the guide member, specifically showing a state that the guide member is pressed by the eccentric cam.

Next, described is an arrangement and operation of a link mechanism in association with the separator device in the case where a thrust driving mechanism is incorporated in the separator device with reference to FIGS. 10 to 11B. FIG. 10A is a side view schematically showing an arrangement of a link mechanism 160 provided with a thrust driving mechanism 150. FIG. 10B is a side view showing also an arrangement of a link mechanism 160 in which a guide member is rotated in a counterclockwise direction from the state shown in FIG. 10A. FIGS. 11A and 11B are side views schematically showing a thrust movement of a guide member 125. Specifically, FIG. 11A shows a state that the guide member 125 is not pressed by an eccentric cam 152*b*, and FIG. 11B shows a state that the guide member 125 is pressed by the eccentric cam 152*b*.

The link mechanism 160 provided with the thrust driving mechanism 150 is constructed in such a manner that side plates 165 are pivotally supported on a support member 172 about an axis of a rotary shaft 173. The guide member 125 for pivotally supporting separator members 123 is mounted on the side plates 165 in such a manner as to be slidable in an axial direction of the side plates 165 (namely, in forward and rearward directions on the plane of FIG. 10). A worm gear 151*a* and a helical gear 152 meshed with the worm gear 151*a* are arranged on one side of the guide member 125 (namely, on a left side of the left-side plate 165 in FIGS. 11A and 11B) in a state that the link mechanism 160 is closed and the separator members 123 are rendered in contact with a heater roller 121.

Support shafts 125*d*, 125*e* are provided on axially opposite end portions of the guide member 125, respectively. Fittingly inserting the support shafts 125*d*, 125*e* in holes formed in the side plates 165, 165 respectively arranged at the axially opposite ends of the guide member 125 allows the support shafts 125*d*, 125*e* to be slidable relative to the side plates 165, 165, respectively. A spring 130*a* is mounted on the support shaft 125*d* located closer to the eccentric cam 152*b* in such a manner that the spring 130*a* is provided between the left side of the guide member 125 and a left-side support plate 129 of a fixing device 12 in FIGS. 11A and 11B. Where the spring 130*a* is maintained in a stretched state so that the stretched spring 130*a* tends to pull the guide member 125 to eccentric cam 152*b*. A spring 130*b* is mounted on the support shaft 125*e* in such a manner that the spring 130*b* is provided between a right side of the guide member 125 and a right-side support plate 129 of the fixing device 12 in FIGS. 11A and 11B. The spring 130*b* the spring 130*a* is maintained in a compressed state so that the compressed spring 130*b* tends to pull the guide member 125 (from right to left in FIG. 11A or FIG. 11B) to eccentric cam 152*b*. The guide member 125 is urged toward the eccentric cam 152*b* by the springs 130*a* and 130*b*.

A contact portion 127 is formed on the side portion of the guide member 125 corresponding to the side of the eccentric cam 152*b* at a position outside the side plate 165 (in FIGS. 11A and 11B, above left-side the side plate 165). Rotating the eccentric cam 152*b* to press the contact portion 127 in a horizontal direction via a horizontally and transversely movable presser member 190 reciprocates the guide member 125 in the axial direction of the guide member 125 against the bias force (urging force) of the stretched spring 130*a* and the urging force of the compressed spring 130*b* in accordance with rotation of the eccentric cam 152*b*. Thereby, the guide member 125 and the separator members 123 are subjected to thrust movement. In this arrangement, merely the guide member 125 is transversely moved without pressingly and transversely moving the side plates 165 by the eccentric cam 152*b*.

As shown in FIGS. 11A and 11B, the presser member 190 includes a presser shaft 190*a* which is supported on the left-side support plate 129 to be movable horizontally and transversely, and a presser plate 190*b* which is mounted on one end portion of the presser shaft 190*a* and is moved horizontally and transversely along with the presser shaft 190*a*. The left-side support plate 129 is formed with a support portion 129*a* for supporting the presser shaft 190*a* to be horizontally movable. The presser shaft 190*a* is inserted in a hole each formed in the support portion 129*a* and the left-side support plate 129. The presser shaft 190*a* extends from the eccentric cam 152*b* to the guide member 125 by passing through the holes. The presser plate 190*b* is rendered in contact with the contact portion 127 of the guide member 125 in a state that the link mechanism 160 is closed. The presser plate 190*b* presses the guide member 125 in the same direction as the presser shaft 190*a* is horizontally and transversely moved.

A pin 165*b* is provided on each of the side plates 165 to regulate the guide member 125 at a certain posture in association with an engagement of the pins 165*b* with guide rails 175. Specifically, one of the pins 165*b* (left-side pin 165*b* in FIGS. 11A and 11B, hereinafter, referred to as "cam-side pin 165*b*")) is provided on a surface of the left-side plate 165 opposing the eccentric cam 152*b*, and the other one of the pins 165*b* (right-side pin 165*b* in FIGS. 11A and 11B, hereinafter, referred to as "housing-side pin 165*b*") is provided on a surface of the side plate 165 opposing the right-side support plate 129. The cam-side pin 165*b* is arranged at such a position as to avoid interference with the presser plate 190*b* even if the presser plate 190*b* is transversely moved toward the guide member 125 by rotation of the eccentric cam 152*b*. The housing-side pin 165*b* is engageable with the right-side guide rail 175. Each pin 165*b* has such an arrangement as to be engageable with the corresponding one of the guiderails 175 in association with open/close operations of the link mechanism 160.

Now, a thrust movement of the guide member 125 accompanied by rotation of the eccentric cam 152*b* is described. As shown in FIG. 11A, the eccentric cam 152*b* does not press the presser shaft 190*a* as long as a distance 1 between an axis of rotation of a rotary shaft 152*a* of the eccentric cam 152*b* and one end surface of the presser shaft 190*a* is kept shortest. At this time, the presser plate 190*b* is rendered into contact with an inner side surface of the left-side support plate 129. In this state, the presser plate 190*b* is prohibited from pressing the guide member 125 (namely, the contact portion 127).

As the eccentric cam 125*b* is rotated from the above state, namely, as the distance 1 is gradually longer, as shown in FIG. 11B, the presser plate 190*b* is gradually detached from the left-side support plate 129. As the presser plate 190*b* is detached, the guide member 125 is pressed and slidingly moved horizontally in the rightward direction in FIGS. 11A and 11B.

In the case where the guide member 125 is pivotally moved upward in counterclockwise direction as shown in FIG. 10B to render the sheet transport path 15 accessible (namely, to expose the sheet transport path 15), the contact portion 127 of the guide member 125 is moved upward in sliding contact with the presser plate 190*b*, as the pins 165*b* are guided upward along the guide rails 175. As mentioned above, since the cam-side pin 165*b* is so configured as to avoid interference with the presser plate 190*b*, there is no likelihood that the presser plate 190*b* interferes the upward movement of the guide member 125 and the side plates 165.

Alternatively, the worm gear 151*a* and the helical gear 152 may be automatically rotated so as to render the presser plate 190*b* in contact with the left-side support plate 129, as shown in FIG. 11A, when the guide member 125 and the side plates 165 are gradually lowered to define the sheet transport path 15 in a closing operation of the link mechanism 160. As a further altered arrangement, an operator may manually turn a knob 151 to render the presser plate 190*b* in contact with the left-side support plate 129. With this arrangement, the contact portion 127 is desirably engaged with the left-side guide rail 175 without a likelihood that the presser plate 190*b* interferes urging movement of the contact portion 127 toward the guide rail 175 even after the contact portion 127 has its pressing by the presser plate 190*b* released and is being urged toward the eccentric cam 152*b* by the bias force of the stretched spring 130*a* and the urging force of the compressed spring 130*b*

As mentioned above, in the embodiment, the fixing device 12 provided with the link mechanism 160 is advantageous in that (1) the separator members 123 are reciprocated in the axial direction of the heater roller 121 without providing an additional drive source and that (2) the separator members 123 and peripheral parts thereof are retractable from the heater roller 121 without requiring a large space and that (3) the sheet transport path 15 is easily rendered accessible for an operator, thereby providing improved operability in removing a jammed sheet or the like. These advantages are obtained by providing the link mechanism 160 with the thrust driving mechanism 150.

In the embodiment, a retaining portion 182 is provided to retain the guide member 125 at an opened posture in which the guide member 125 extends in a direction generally orthogonal to the sheet transport direction in the case where the support member 172 is operated to retract the guide member 125 away from the heater roller 121. This arrangement provides a large space for a fixing roller pair and the sheet transport path, thereby securing a large operating space for an operator to remove a jammed sheet or the like.

In the embodiment, a projection 177*a* of the stopper member 177 is engaged with a side end portion 181*a* of the housing wall 181 in the case where the support member 172 is set to an opened posture in which the support member 172 extends in a direction generally orthogonal to the sheet transport direction to move the guide member 125 away from the guide fixing portion. This arrangement keeps the support member 172 from being tilted in such a direction as to resultantly reduce the operating space and hinder jammed sheet removal operation with a simplified construction.

Also, the guide member 125 is retained at a certain posture relative to the support member 172 by engagement of the pins 125*b* with the guide rails 175 when the support member 172 is being pivotally rotated. This arrangement enables to optimally regulate the posture of the guide member 125 when the guide member 125 is being moved toward and away from the guide fixing portion.

In the embodiment, a contact portion 125*a* is abutted against an inner wall 172*a* of the support member 172 upon completion of a pivotal rotation of the guide member 125 relative to the support member 172 by a certain amount to prevent a further pivotal rotation of the guide member 125 when the guide member 125 is being moved toward and away from the guide fixing portion by the pivotal rotation of the support member 172. This arrangement enables to retain the guide member 125 at a certain posture when the guide member 125 is being moved toward and away from the guide fixing portion.

The support member 172 is provided with the stopper member 177 to retain the guide member 125 at a certain posture relative to the guide fixing portion. Pivotal rotation of the stopper member 177 enables to changeably set the guide member 125 at a retained position and releases its positioning. Thereby, the guide member 125 along with the guide fixing portion securely defines the horizontally extending sheet transport path 15 with a simplified construction.

The guide member 125 is provided with a cover member 167 that is operable to expose the separator members 123 in and out of the cover member 167. The cover member 167 is operated in such a manner that the cover member 167 exposes the sheet separators 123 when the guide member 125 is lowered to define the sheet transport path 15 and that the cover member 167 covers the sheet separators 123 when the guide member 125 is moved upward away from the guide fixing portion. This arrangement provides further improved safety measure in operation such as jammed sheet removal and preventing the separator members 123 from being damaged or broken.

The embodiment in which the link mechanism 160 is equipped with the thrust driving mechanism 150 may take the following modifications and alterations.

(1) In the embodiment, the presser member 190 is adapted to press the guide member 125 horizontally in accordance with rotation of the eccentric cam 152*b*. Alternatively, a support plate 129 between an eccentric cam 152*b* and a guide member 125 may be formed with a cutaway portion to render a side portion of the eccentric cam 152*b* in direct contact with a contact portion 127 of the guide member 125 through the cutaway portion.

(2) In the embodiment, the presser shaft 190*a* and the presser plate 190*b* constitute the presser member 190. Alternatively, a presser member 190 may be provided between an eccentric cam 152*b* and a contact portion 127 (or guide member 125) to press the guide member 125 in accordance with rotation of the eccentric cam 152*b*.

This application is based on Japanese patent application Nos. 2001-93880, 2001-99304, and 2001-389493 filed in Japan Patent Office, the contents of which are hereby incorporated by references.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An image forming apparatus comprising:

a pair of fixing rollers which are rotated to fix an image on a sheet;

a sheet separator which is rendered into contact with at least one of the fixing rollers to separate the sheet from the roller; and drive means driven by a drive source which rotates the fixing roller or a transport roller disposed downstream of the fixing roller pair along a sheet transport direction, said drive means converts a rotation motion of said drive source to a linearly reciprocating motion of said sheet separator along the axial direction of the fixing roller.

2. The image forming apparatus according to claim 1, further comprising a guide member for guiding a sheet in the sheet transport direction along a sheet transport path located downstream with respect to the fixing roller pair, wherein the drive means including:

a worm gear which is rotated by the driving force of the drive source for rotating the fixing roller or the transport roller;

a worm wheel which is meshed with the worm gear; and a cam which is provided on a rotary shaft of the worm wheel to be rotatable with the worm wheel, and the sheet separator is supported on the guide member and the cam is so configured as to be rotatable while pressing the guide member so as to reciprocate the guide member in the axial direction of the fixing roller in accordance with the rotation of the cam.

3. The image forming apparatus according to claim 1, wherein the sheet separator is reciprocated by an amount equal to or larger than a width of the sheet separator in the axial direction of the fixing roller.

4. The image forming apparatus according to claim 1, wherein the sheet separator is reciprocated in a range corresponding to a width of the sheet to be transported toward the fixing roller pair in the axial direction thereof.

5. The image forming apparatus according to claim 1, wherein the relationship between a peripheral speed of the fixing roller and the reciprocating motion of the sheet separator is set such that the circumferential traveling distance L of the fixing roller in a time period, during which the sheet separator completes a one reciprocating motion, is in a range of $0.5\ m \leqq L \leqq 20\ m$.

6. An image forming apparatus comprising:

a sheet separator which separates a sheet from a roller in contact therewith;

a guide member which supports the sheet separator and guides the sheet in a sheet transport direction in a sheet transport path located downstream in the sheet transport direction with respect to the roller;

a support member which pivotally supports the guide member in such a manner as to reciprocate the guide member in an axial direction of the roller and to pivotally rotate the guide member about an axis of the roller, the support member being pivotable to move the sheet separator and the guide member in such a direction as to define the sheet transport path and in such a direction as to expose the sheet transport path; and drive means which converts a rotation motion of a drive source which rotates the roller or a transport roller disposed downstream of the roller along the sheet transport direction to a linearly reciprocating motion of the guide member and the sheet separator in the axial direction of the roller.

7. The image forming apparatus according to claim 6, wherein the drive means including:

a worm gear which is rotated by the driving force of the drive source for rotating the roller or the transport roller;

a worm wheel which is meshed with the worm gear; and a cam which is provided on a rotary shaft of the worm wheel to be rotatable with the worm wheel, and the cam is so configured as to be rotatable while pressing the guide member so as to reciprocate the guide member in the axial direction of the roller in accordance with the rotation of the cam.

8. The image forming apparatus according to claim 6, wherein the sheet separator is reciprocated by an amount equal to or larger than a width of the sheet separator in the axial direction of the roller.

9. The image forming apparatus according to claim 6, wherein the sheet separator is reciprocated in a range corresponding to a width of the sheet to be transported toward the roller in the axial direction thereof.

10. The image forming apparatus according to claim 6, wherein the relationship between a peripheral speed of the fixing roller and the reciprocating motion of the sheet separator is set such that the circumferential traveling distance L of the fixing roller in a time period, during which the sheet separator completes a one reciprocating motion, is in a range of $0.5\ m \leqq L \leqq 20\ m$.

11. The image forming apparatus according to claim 6, further comprising retaining means which retains the guide member at an opened posture in which the guide member extends in a direction substantially orthogonal to the sheet transport direction on the way of pivotally rotating the guide member in such a direction as to expose the sheet transport path by the support member.

12. The image forming apparatus according to claim 6, wherein the support member is so constructed as to be engageable with a housing of a main body of the apparatus in the case in which the guide member is set at an opened posture in which the guide member extends in a direction substantially orthogonal to the sheet transport direction.

13. The image forming apparatus according to claim 6, further comprising regulator means which regulates a posture of the guide member relative to the support member when the guide member is being pivotally rotated in such a direction as to define the sheet transport path and in such a direction as to expose the sheet transport path by a pivotal rotation of the support member.

14. The image forming apparatus according to claim 6, wherein the guide member is engaged with the support member upon completion of a pivotal rotation of the guide member relative to the support member by a specified amount when the guide member is being pivotally rotated in such a direction as to define the sheet transport path and in such a direction as to expose the sheet transport path by a pivotal rotation of the support member so as to stop the pivotal rotation of the guide member thereat.

15. The image forming apparatus according to claim 6, wherein the support member includes a stopper member which is pivotally rotatable coaxially with the guide member to retain the guide member at such a position as to define the sheet transport path, a pivotal rotation of the stopper member changeably setting the guide member at the retained position and releasing the guide member from the retained position.

16. The image forming apparatus according to claim 6, further comprising a stopper member which is engageable with a housing of a main body of the apparatus to fixedly support the support member on the housing of the main body of the apparatus when the guide member is set at an opened posture in which the guide member extends in a direction substantially orthogonal to the sheet transport direction.

17. The image forming apparatus according to claim 6, wherein the guide member includes cover means which is switchable its state between to cover and to expose the sheet separator, the cover means having a spring generating a bias force against the cover means to cover the sheet separator, the cover means being operative to expose the sheet separator against the bias force of the spring when the guide member is in a state to define the sheet transport path and to cover the sheet separator by the bias force of the spring when the guide member is in a state to expose the sheet transport path.

18. The image forming apparatus according to claim 6, wherein the roller includes a fixing roller which is adapted to be rotated to fix an image on the sheet.

19. A sheet separation device for use in an image forming apparatus having a pair of fixing rollers which are rotated to fix an image on a sheet, said separation device comprising:

a sheet separator which is rendered into contact with at least one of the fixing rollers to separate the sheet from the roller; and a drive unit for reciprocating said sheet separator in the axial direction of the fixing roller, said drive unit is driven by a drive mechanism for rotating the fixing roller and converts the rotation motion of the drive mechanism to the reciprocating motion of the sheet separator along the axial direction of the fixing roller.

* * * * *